US009149138B2

(12) United States Patent
Miller

(10) Patent No.: US 9,149,138 B2
(45) Date of Patent: Oct. 6, 2015

(54) DRINKING VESSEL

(75) Inventor: Austen Miller, Hampshire (GB)

(73) Assignee: OZ10 Limited, Hampshire (GB)

( * ) Notice: Subject to any disclaimer, the term of this patent is extended or adjusted under 35 U.S.C. 154(b) by 226 days.

(21) Appl. No.: 13/810,125

(22) PCT Filed: May 13, 2011

(86) PCT No.: PCT/GB2011/050921

§ 371 (c)(1),
(2), (4) Date: May 28, 2013

(87) PCT Pub. No.: WO2012/007731

PCT Pub. Date: Jan. 19, 2012

(65) Prior Publication Data

US 2013/0233870 A1 Sep. 12, 2013

(30) Foreign Application Priority Data

Jul. 12, 2010 (GB) ..... 1011657.2

(51) Int. Cl.
*A47G 19/22* (2006.01)

(52) U.S. Cl.
CPC ..... *A47G 19/22* (2013.01); *A47G 19/2272* (2013.01)

(58) Field of Classification Search
CPC ..... B65D 47/2018; B65D 51/10; B65D 51/1611; B65D 2543/00046; B65D 47/2031; B65D 47/2081; B65D 51/165; A47G 19/2272
USPC ..... 220/719, 711, 714
See application file for complete search history.

(56) References Cited

U.S. PATENT DOCUMENTS

| | | | | |
|---|---|---|---|---|
| 3,360,160 | A * | 12/1967 | Spencer | 220/719 |
| 5,890,619 | A * | 4/1999 | Belanger | 220/713 |
| 6,202,877 | B1 * | 3/2001 | La Torre et al. | 220/254.1 |
| 7,100,790 | B2 * | 9/2006 | Dark | 220/711 |
| 8,453,870 | B2 * | 6/2013 | Berg et al. | 220/703 |
| 2005/0056653 | A1 * | 3/2005 | Miller | 220/710.5 |

FOREIGN PATENT DOCUMENTS

| | | | |
|---|---|---|---|
| GB | 2447446 | A | 9/2008 |
| WO | 2009126042 | A1 | 10/2009 |

OTHER PUBLICATIONS

Examination Report issued in the corresponding Chinese Application No. 201180034205.6, Feb. 8, 2014, 9 pages.

* cited by examiner

*Primary Examiner* — Shawn M Braden
(74) *Attorney, Agent, or Firm* — Raymond R. Ferrera; Adams and Reese LLP

(57) ABSTRACT

A drinking vessel comprises a generally cylindrical container (10) for containing liquid, and a lid (20). The lid comprises a generally cylindrical inner member (21) and a generally cylindrical sealing element (30) which surrounds the inner member (21). The container 10 further comprises a rim (14) and an inner circumferential sealing surface (15). The lid (20) is fixedly insertable into the container 10 in order, when the lid (20) is inserted, to cause the sealing element (30) to lie against the sealing surface so as normally to form a seal with the sealing surface (15). The seal is deformable by suction at the rim (14) such that under the action of the suction liquid within the container (10) is caused to flow from a chamber (13) inside the container out past the rim (14).

15 Claims, 13 Drawing Sheets

SECTION A-A

SECTION D-D

SECTION E-E

SECTION C-C

DRINKING VESSEL

FIELD OF THE INVENTION

This invention relates to a drinking vessel of the type that, for example, comprises a generally cylindrical seal that lies against a generally cylindrical sealing surface in order to enable a user to draw liquid from a rim of the drinking vessel.

BACKGROUND OF THE INVENTION

Trainer cups that comprise a container for liquid and a lid including a mouthpiece, usually in the form of a spout, are well known for use at an intermediate stage in a child's development as the child moves from drinking from a feeding bottle or the breast to drinking from a conventional cup or glass.

However, at that stage, the child will not have learned that if cups are knocked over or shaken, the liquid inside will be spilt. Accordingly, there is a need for the development of trainer cups which are adapted not to spill their contents when shaken or upturned.

United Kingdom Patent Specification GB-A-2 266 045 describes such a cup in which a one-way valve is provided within the spout of the lid of a trainer cup. The valve is formed by a slit formed in an externally convex portion of a sheet of flexible material such as latex or silicone rubber. The valve opens in response to suction on the spout by the child, thereby allowing egress of fluid from the cup. The convexity of the valve provides the one-way characteristic of the valve. A second one-way valve is provided to allow ingress of air into the cup to prevent the build-up of a vacuum.

However, at some stage in a child's development, it will need to learn the skills involved in drinking from the rim of an ordinary cup as opposed to the intermediate type of vessel having a spout. Typically, this is done by wholly removing the lid from the trainer cup to prevent use of the spout. However, in doing so, the spill-resistance advantages are completely lost. The object of the present invention is to provide an improved drinking vessel which can be used as a trainer cup without employing a spout.

As well as being used by children, non-spill and shock resistant drinking vessels can be found useful by a range of other users. For example, the elderly, infirm, the disabled, and those returning from injury would also require such a drinking vessel, as there is an increased chance that the drinking vessel will be dropped on the floor or knocked over. A runner would also require a shock resistant drinking vessel, which would need to be designed to withstand shocks of a different nature to those of other end users. For example, the shock to a drinking vessel when it is dropped affects the fluids dynamics inside the vessel differently than if the vessel is subjected to repeated movements when being held by a runner. As such, a drinking vessel may be required to exhibit different and/or additional shock resistance characteristics depending on the nature of the end use of the drinking vessel.

United Kingdom patent specification no. GB-B-2 401 857 relates to an alternative cup that comprises a cylindrical container and a lid, the lid having a cylindrical outer element that provides a sealing surface, an annular seal and an inner element that serves to trap the seal between an inner surface of the outer element and an outer surface of the inner element. The annular seal and the sealing surface therefore form an annular valve. In use, a user sucks from the rim of the lid, causing a portion of the annular seal of the valve to rise from the sealing surface, thereby allowing liquid contained within the container to flow through the lid to the mouth of the user trying to drink from the cup via the opened portion of the valve. However, the alternative cup of this type employing the annular valve in the lid does not provide an optimum seal to prevent egress of liquid from the container, particularly when the cup is exposed to so-called "shock" movements, for example when the cup is suddenly shaken. Furthermore, it is also desirable to reduce the number of piece parts used to make the cup.

SUMMARY OF THE INVENTION

According to a first aspect of the invention, there is provided a drinking vessel comprising a generally cylindrical container for containing liquid and a lid, the lid comprising a generally cylindrical inner member and a generally cylindrical sealing element surrounding the inner member, wherein the container further comprises a rim and an inner circumferential sealing surface, the lid being fixedly insertable into the container in order, when the lid is inserted, to cause the sealing element to lie against the sealing surface so as normally to form a seal with the sealing surface, the seal being deformable by suction at the rim such that under the action of the suction liquid within the container is caused to flow from a chamber inside the container out past the rim.

According to a second aspect of the invention, there is provided a drinking vessel comprising a generally cylindrical container for containing liquid, a generally cylindrical lid arranged to close the container, the lid comprising a generally cylindrical outer member having a rim and an inner circumferential sealing surface, a generally cylindrical inner member, a generally cylindrical sealing element surrounding the inner member and insertable within the outer member so as to bring the sealing element into abutment with the sealing surface, wherein the sealing element lies against the sealing surface so as normally to form a seal with the sealing surface, the seal being deformable by suction at the rim such that under the action of the suction liquid within the container is caused to flow from the chamber inside the container out past the rim.

So that liquid may efficiently pass through the seal when suction has been applied to the rim, the sealing member and the sealing surface may cooperate to define a plurality of circumferential channels. The plurality of channels may extend from the rim towards the base of the container, for example downwardly, and/or extend substantially in parallel from the end of the seal adjacent the rim down to or at a point near the base of the seal. The channels could extend in respective axes substantially parallel with a central axis of the seal and, when assembled, a longitudinal axis of the vessel. The channels could be capillaries or alternatively be formed from grooves in the outer surface of the sealing element.

The channels may contain a kink therein. This feature is provided in order to mitigate leakage from the seal formed between the sealing element and the sealing surface in the event of a so-called "shock condition" when the drinking vessel is shaken, possibly violently. This kink is provided in both the sealing element and the inner surface of the container or outer member (if present) in order to contribute to a labyrinthine path for liquid to follow to exit the vessel. Consequently, the inner surface of the container or outer member would mirror or follow this formation of the sealing element so as to provide a circumferential shoulder as part of the sealing surface. Where channels are provided, the portions of the sealing element and the sealing surface supporting the channels are in abutment when the drinking vessel is not being used.

These labyrinthine channels in certain instances will be spaced between about 0.4 mm to about 6 mm apart, but this range should not be understood as limiting. Spacing is configured dependent on drink flow rate requirements to suit the target user. If a higher drinking flow rate is required, closer labyrinthine channel spacing can be used to ensure a greater number of channels fit inside the user's lips when applied to the seal. The labyrinthine channels up the side of the seal may have a nominal cross sectional area typically between about 0.8 $mm^2$ and about 3.5 $mm^2$, and a total length typically from about 5 mm to about 30 mm, depending upon application of the drinking vessel. This length range can include changes in direction of the labyrinthine path of the channels. It should be understood that the length and cross section of each labyrinthine channel is configured to possess suitable dimensions so that fluid striking an "entrance" of a labyrinthine channel is restricted and damped in its flow along the channel so that there is not enough inertia in the liquid to lift the seal at the end of the labyrinthine channel near the rim. The damping and restriction on the fluid is achieved due to boundary layer and turbulent flow effects on the fluid as it passes though the labyrinthine channels, which are configured to a suitable size based upon the required sealing performance of the drinking vessel, for example an adult runner would require higher seal shock load performance than a drinking vessel only tailored to resist spilling when knocked over, such as on a desk.

The proportions of the labyrinthine channel configuration can be tailored to generate higher flow but reduced sealing range and vice versa. The labyrinth system can be reduced in cross sectional area and increased in length to improve shock loading performance, but this also reduces drinking flow rate for the user of the drinking vessel.

The channels may deviate from a linear path and be generally V- or chevron shaped, or alternatively, the channels may zigzag between the upper and lower edges of the sealing element. By deviating the path of the channels, their overall length will increase relative to a linear channel, thus increasing the shock loading performance.

An inlet may be disposed in the sealing element at the entrance to the channels, with the inlet being in fluid communication with two or more channels, so that the liquid may enter the two or more channels through a common inlet. By reducing the total number of inlets, or in effect increasing the number of channels per inlet, the fluid resistance and therefore the shock loading performance of the vessel will be increased. The performance improvement will in part be due to the enlarged volume into which the fluid can flow, the increase in space available to the liquid being, in this example, as the inlet splits into two or more channels.

Different types of shock, for example shock caused by the swinging of a vessel as opposed to dropping it, affects the liquid in the vessel differently. Increasing the number of channels per inlet or increasing the length of the channels by introducing a kink or change of direction, will affect the liquid dynamics depending on the shock applied thereto. Therefore, these strategies of providing non-linear channels and multiple channels per inlet may be combined, or these strategies may be provided separately in different drinking vessels, depending on the performance required.

Hence, it can be seen that the sealing element cooperates with the sealing surface in order to provide a plurality of labyrinthine or non-straight channels or paths as a nexus between an internal volume of a drinking vessel and a rim of the drinking vessel.

According to the first aspect of the invention, the container may carry an internal thread at an upper end thereof below the rim, with the inner member having a counterpart external thread for engaging the container using the internal thread of the container. In order to prevent over-insertion and therefore application of excessive force on the sealing surface by the sealing element, a stop may be provided at a suitable position along the internal thread. It should nevertheless be appreciated that other techniques can be employed in order to maintain the lid in the container, for example a releasable snap fit.

It should also be appreciated that although the container according to the second aspect of the invention does not comprise a lid that screws into the container, such a lid can be provided based upon the above described principle. In this respect, the lid further comprises an outer member into which the above-mentioned inner member and sealing element screws. In such an example, the vessel carries an outer thread below a rim of the container for engagement with a counterpart inwardly-facing thread carried by the outer member. The outer member comprises a rim and an internal surface constituting a sealing surface. In order to prevent over-insertion and therefore application of excessive force on the sealing surface by the cylindrical seal, a stop may also be provided at a suitable position along the internal thread. Of course, as mentioned above, other techniques can be employed in order to maintain the lid in the outer member, for example a releasable snap fit.

In relation to the above embodiments, in order to facilitate the insertion of the inner member into the vessel or the outer member (depending upon implementation), the inner member further includes a grip that extends diametrically across the inner member.

In order to relieve pressure build-up in the vessel, the sealing element may include one or more air valves which equalise the pressure in the vessel after liquid has been withdrawn therefrom following or during a sucking action with respect to the seal. The air valves control the level of vacuum inside the cup. To increase cup sealing performance, the internal vacuum can be increased, which increases cup sealing performance as the outer edge seal at the rim is sucked closed by the internal vacuum.

Although, in the above examples, reference is made to a cylindrical sealing element that can be formed as a single piece part, for example an elastomeric seal formed over a polypropylene inner member, the sealing element can be an annular seal that can be, for example, removably pulled over the inner member. The sealing element is deformable so that it can move away from the sealing surface under suction to permit egress of fluid, but also so that the sealing element returns to its original position forming a seal.

Regarding the second aspect of the present invention, the outer member may be releasably detachable from the container. This may be done by way of cooperating screw threads on the outer element and container, by way of a releasable snap fit attachment mechanism, or any other suitable alternative. One advantage of the second aspect of the present invention is that the lid may be removed to refill the container without the sealing element being removed from against the sealing surface.

It is thus possible to provide a drinking vessel that has a better seal than provided by other non-spill drinking vessels where the user drinks from the rim of the cup. In this respect, egress of liquid from the cup is reduced further under shock force conditions. Furthermore, the drinking vessel can be constructed from fewer parts, and so is easier for a user to assemble, and fewer parts need to be cleaned, thereby improving manual cleaning time. Additionally, the need for fewer parts reduces manufacturing burden in respect of the vessel, which has both environmental and financial benefits.

BRIEF DESCRIPTION OF THE DRAWING

At least one embodiment of the invention will now be described, by way of example only, with reference to the accompanying drawings, in which.

DETAILED DESCRIPTION OF THE INVENTION

Figure 1:
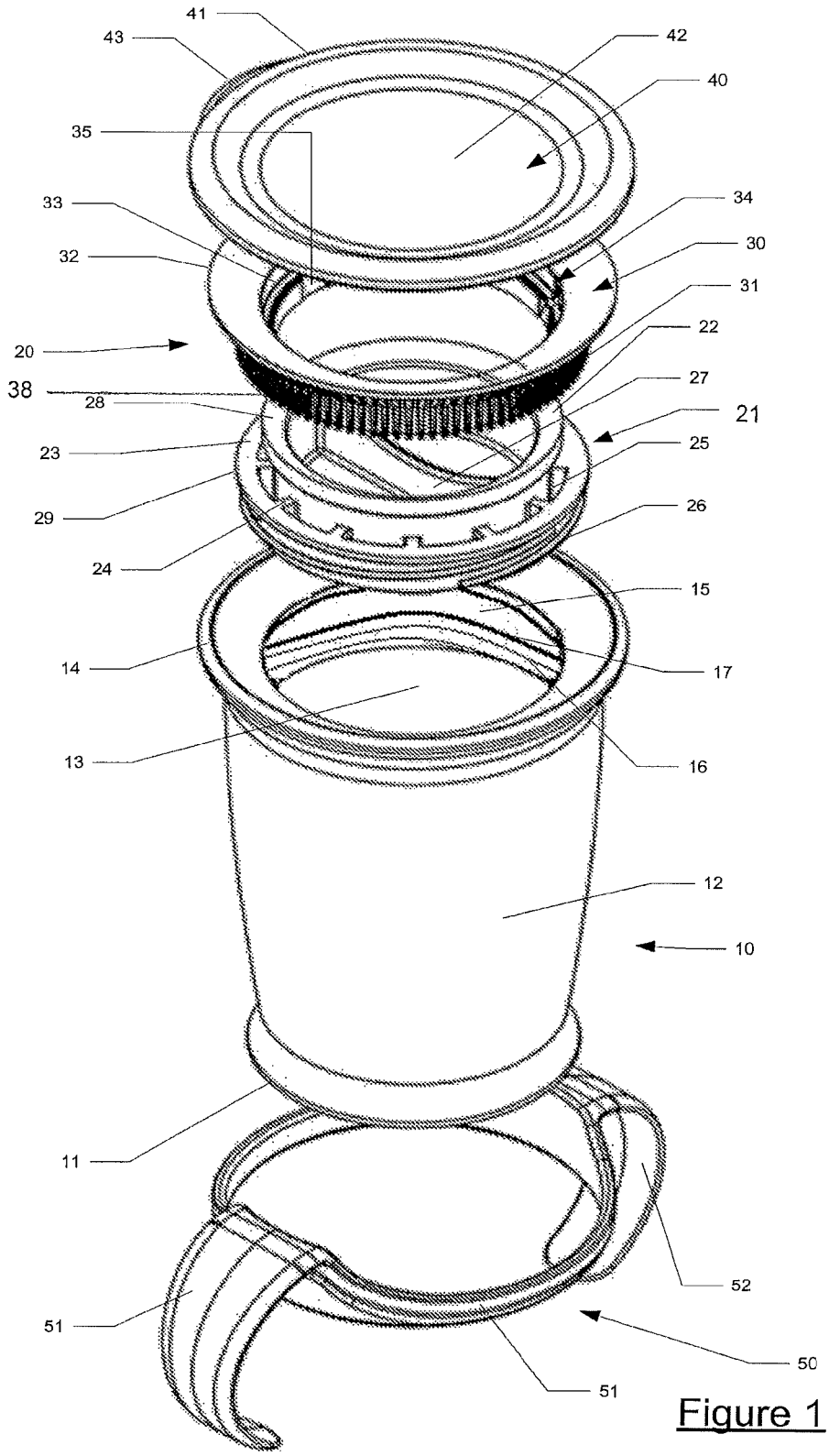
FIG. 1 is an exploded view of a drinking vessel constituting a first embodiment of the present invention.
Figure 2:
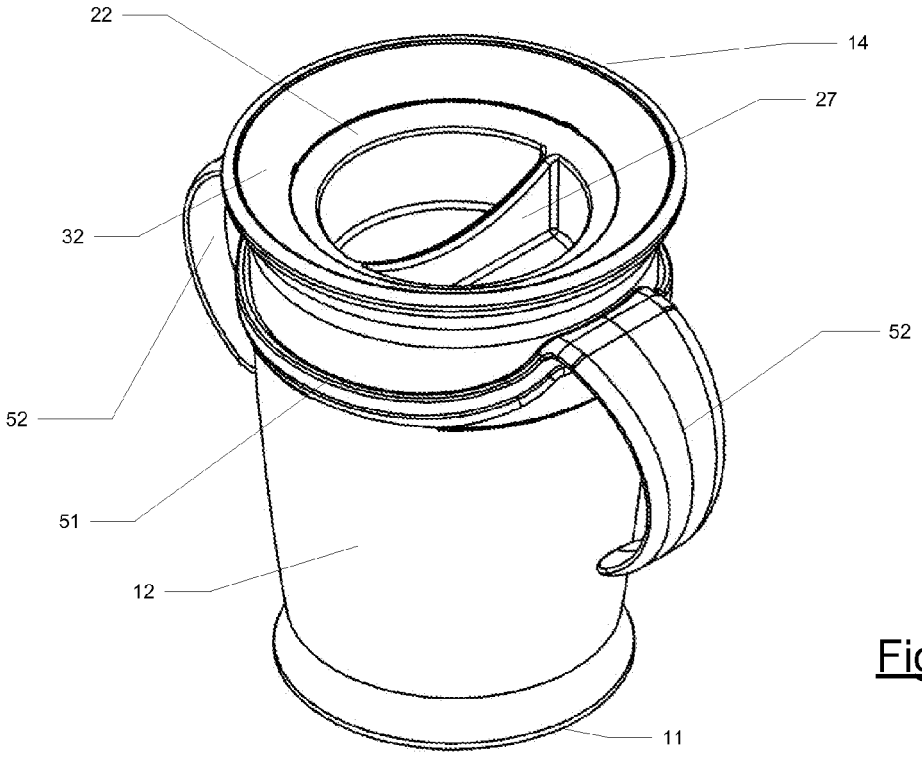
FIG. 2 is an isometric view of a drinking vessel of FIG. 1.
Figure 3:
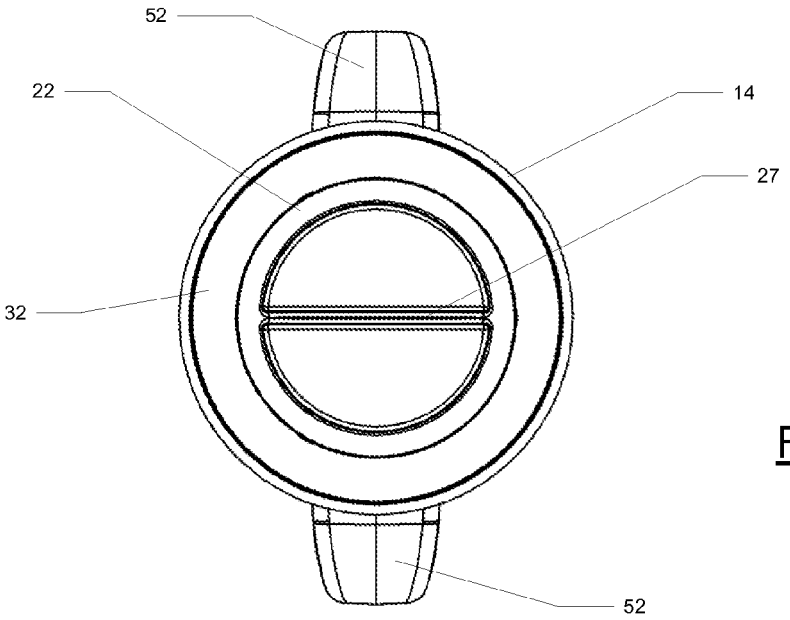
FIG. 3 is a schematic diagram in plan view of the drinking vessel of FIG. 1.
Figure 4:
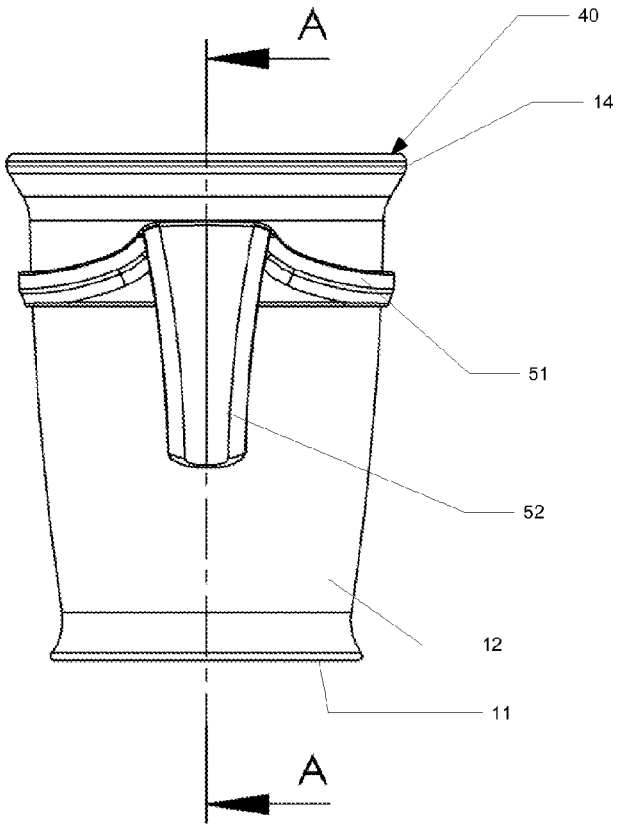
FIG. 4 is a side view of the drinking vessel of FIG. 1.

Throughout the following description, identical reference numerals will be used to identify like parts.

Figure 5:
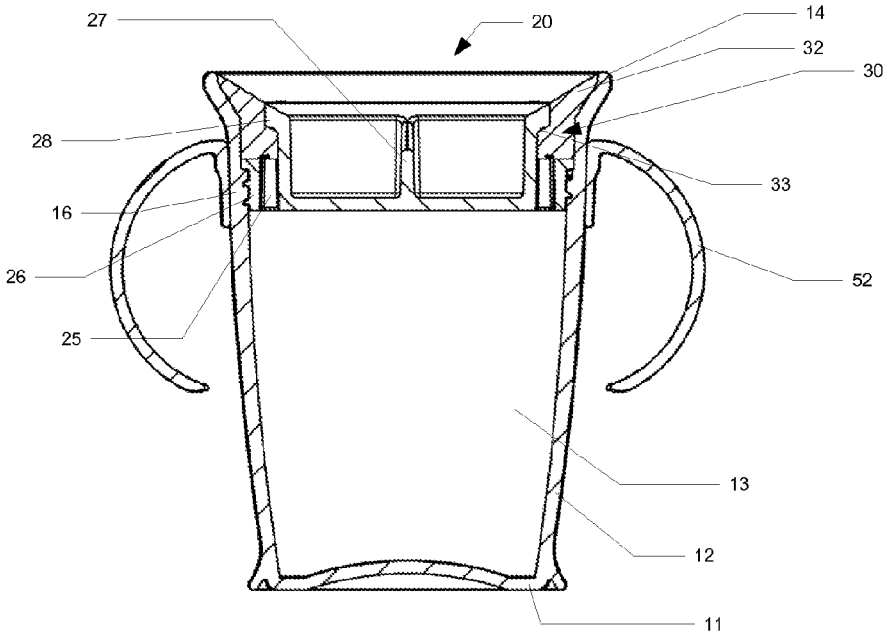
FIG. 5 is a cross-sectional view of the drinking vessel of FIG. 4 along the line A-A.
Figure 6:
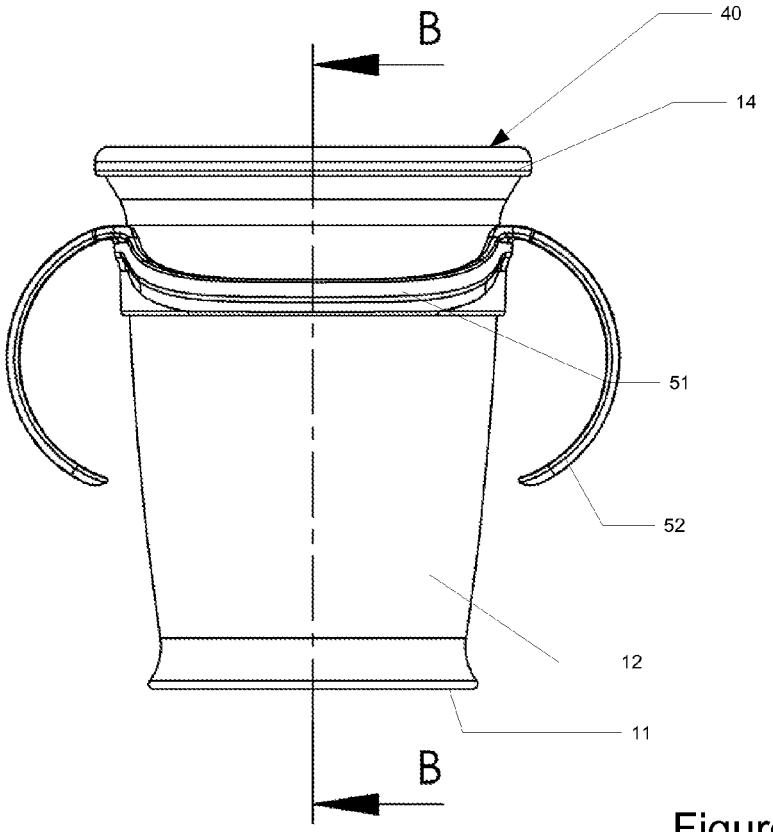
FIG. 6 is another side view of the drinking vessel of FIG. 1.

With reference to FIGS. 1 to 14, and in particular FIGS. 1 and 5, a first embodiment of drinking vessel is shown comprising a container, generally indicated 10, and a lid generally indicated 20. The container 10 comprises a base 11 and an upstanding circumferential side wall 12, defining therein a chamber 13 in which liquid is held during use. An upper edge of the side wall 12 defines a rim 14 from which a user drinks. Disposed within the container is an internal screw thread 16, and positioned above the internal screw thread 16 is a circumferential shoulder 17. Both the internal screw thread 16 and the circumferential shoulder 17 are adapted to engage with the lid 20. An inner sealing surface 15 is defined on the inside of the chamber 13 between an upper edge of the rim 14 and the circumferential shoulder 17.

The lid 20 is releasably attachable to the container 10 and comprises an inner member, generally indicated 21, a sealing element, generally indicated 30, and optionally a cap, generally indicated 40. The inner member 21 comprises a cylindrical inner portion 22 and a coaxial outer portion 23. The outer portion 23 is connected to the inner portion 22 by a series of radial extensions 24, which define a series of apertures 25 therebetween through which liquid can pass. The outer portion 23 has an outer surface that includes an external screw thread 26 arranged to cooperate with the internal screw thread 16 of the container 10, and also an outwardly extending lip 29 disposed above the screw thread 26 which abuts the circumferential shoulder 17 of the container 10 when the lid 20 is attached. The circumferential shoulder 17 acts as a stop which engages with the lip 29 to prevent the lid 20 from being screwed too far into the container 10. Within the cylindrical inner portion 22 is a diametrically disposed upstanding grip 27 which is provided so that the inner member 21 can easily be manually screwed into the container 10. Disposed around the upper edge of the cylindrical inner portion 22 is a first flange 28 which abuts the sealing element 30 to ensure a tight engagement therewith.

The sealing element 30 is made from an elastomeric material and comprises an annular body section 31 having a second flange 32 extending from the upper edge thereof. An annular shoulder 33 is provided at the inner surface of the body section 31. When assembled, it is the shoulder 33 of the sealing element 30 that abuts the first flange 28 disposed around the upper edge of the cylindrical inner portion 22. Further, the body section 31 has a base which abuts the radial extensions 24 between the inner portion 22 and the coaxial outer portion 23 of the inner member 21. The body section 31 of the sealing element 30 creates a fluid-tight seal with the inner portion 22 of the inner member 21. The second flange 32 on the sealing element 30 abuts the rim 14 of the container 10 and creates a fluid-tight seal therewith, the second flange 32 and the rim 14 combining to form a surface from which a user draws liquids during use.

Figure 7:
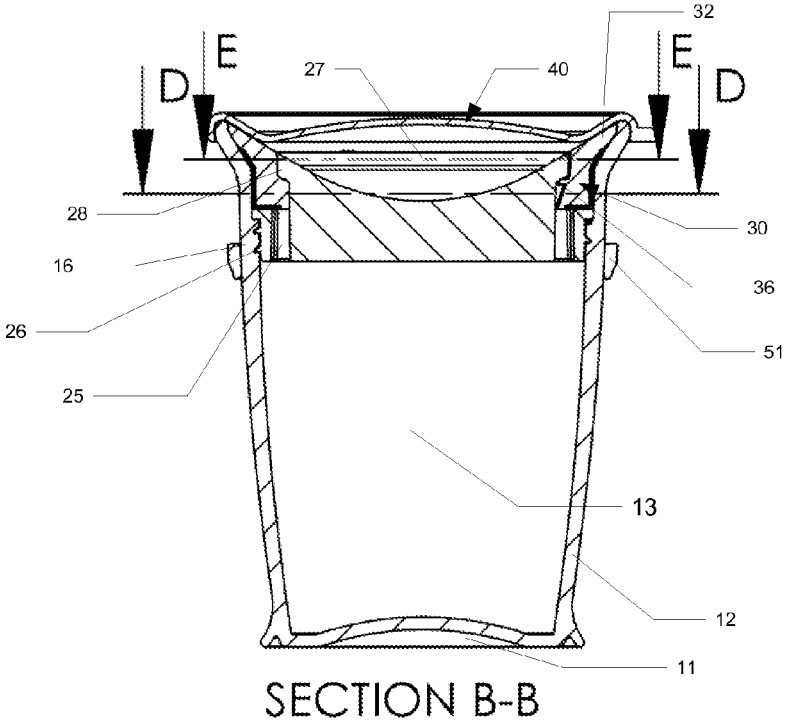
FIG. 7 is a cross-sectional view of the drinking vessel of FIG. 6 along the line B-B.
Figure 11:
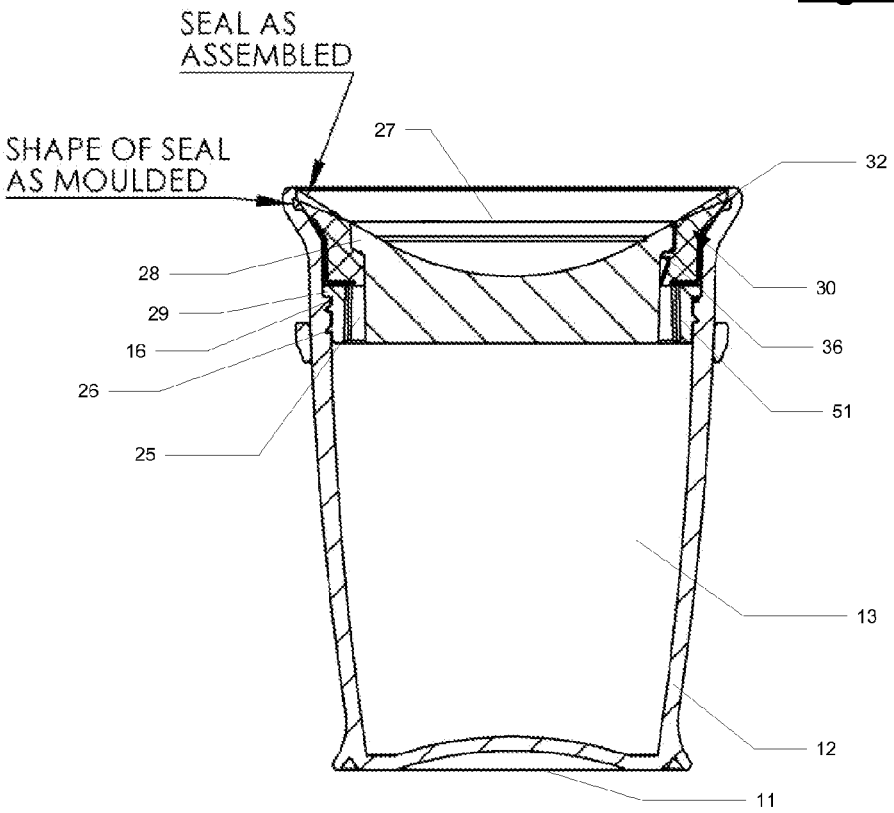
FIG. 11 is a cross-sectional view of the drinking vessel of FIG. 10 along the line C-C.
Figure 12:
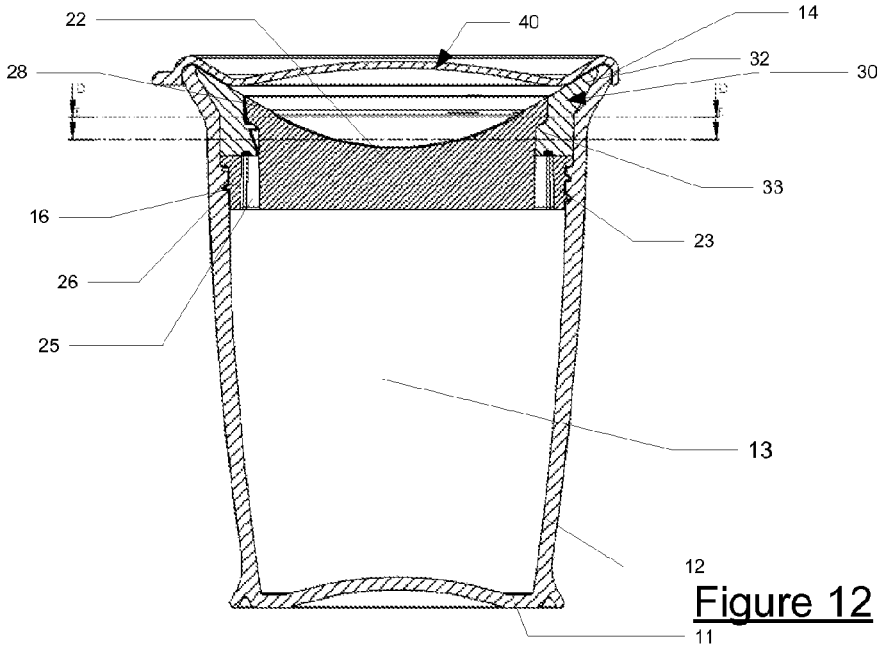
FIG. 12 is a schematic diagram of a pressure relief valve.

Positioned around an inner surface of the body section 31 are a series of air valves, generally indicated 34, which comprise notches 35 and outwardly extending flaps 36 (FIGS. 7 and 11). The air valves 34 act to equalise pressure in the drinking vessel that accrues after liquid has been withdrawn from the chamber 13 during use. The air valves 34 control the level of vacuum inside the cup. At rest the flaps 36 abut the flange 28 and create a fluid-tight seal to prevent liquid from leaving the container 10 through the air valves 34. The flaps 36 are deformable away from the flange 28 to allow air to enter the container 10 when the air pressure inside the chamber 13 is less than the air pressure on the outside of the chamber 13, and air then enters to equalise the pressure.

Figure 8:
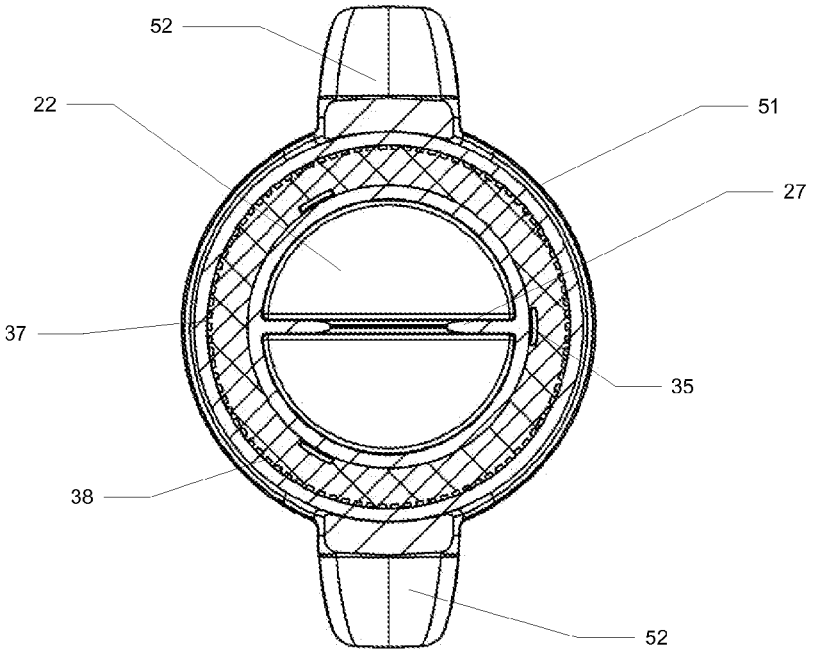
FIG. 8 is a cross-sectional view of the drinking vessel of FIG. 7 along the line D-D.
Figure 9:
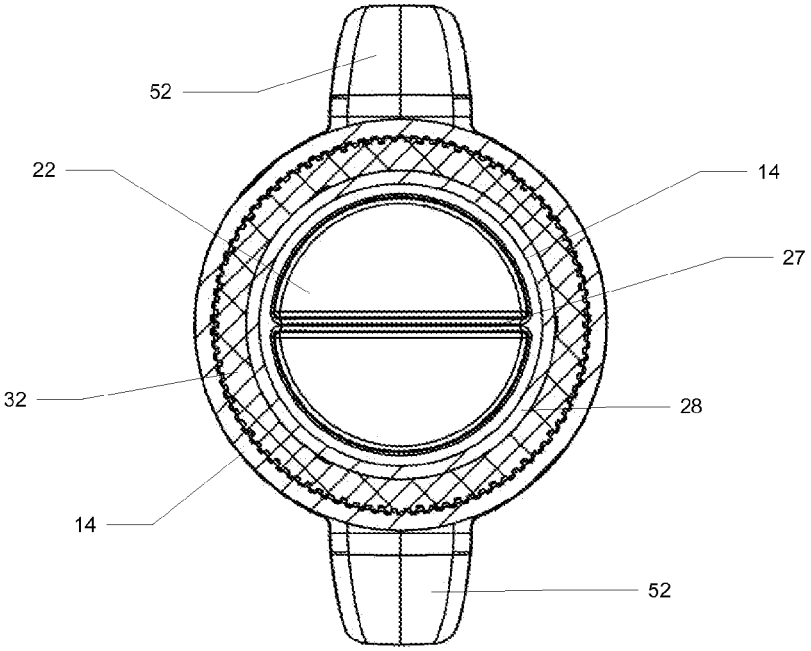
FIG. 9 is a cross-sectional view of the drinking vessel of FIG. 7 along the line E-E.
Figure 10:
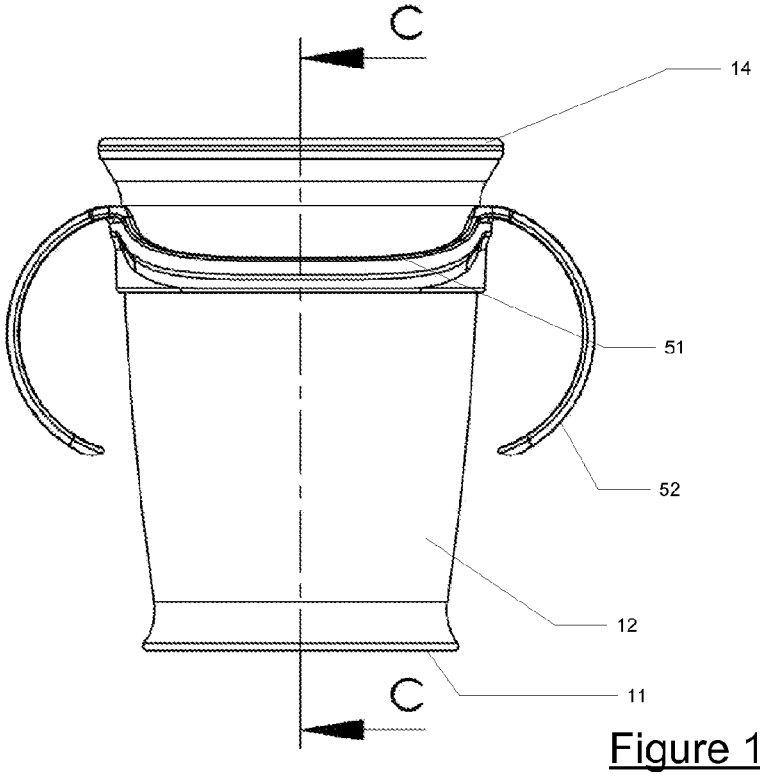
FIG. 10 is a further side view of the drinking vessel of FIG. 1.

Referring to FIGS. 1 and 8, disposed around and extending the length of the outer surface of the body section 31 of the sealing element 30 are a series of parallel projections 37, defining therebetween a series of channels 38. The channels 38 are in fluid communication with the apertures 25 between the radial extensions 24 on the inner member 21 of the lid 20, and also between the lip 14 and the second flange 32. The channels 38 can be spaced apart between 0.4 mm and 6 mm and between 5 mm and 30 mm long, depending on the required application. The channels 38 form part of a labyrinthine flow system, discussed below, to prevent unintentional egress of liquid from the container 10 when it is subjected to shock conditions such as being shaken.

The cap 40 is generally circular and comprises a cap rim 41, a recessed central portion 42 and an opening flap 43. The recessed central portion 42 locates over the inner portion 22 of the inner member 21, and the cap rim 41 surrounds the rim 14 of the container and the second flange 32 of the sealing element 30 to close the drinking vessel and to prevent completely any liquid therein from leaking. The opening flap 43 is disposed at the periphery of the rim 41 and provides a user with a suitable surface to remove the cap 40. It is intended that the cap 40 be attached to the container 10 when not in use, and it can easily be removed when the drinking vessel is used.

The drinking vessel further comprises a removable grip 44, comprising an annular joining section 45 that engages with the side wall 12 of the container 10, and two handles 46 projecting therefrom. The grip 44 can be attached to the container 10, by inserting the base 13 of the container 10 into the joining section 45 and then sliding the joining section 45 up over the side wall 12 of the container. As shown in FIG. 1 in particular, the circumference of the side wall 12 increases from the base 13 towards the rim 14 of the container 10. The joining section 45 engages with the side wall 12 once the circumference of the joining section 45 equals that of the side wall 12 to form a snug fit.

As is more clearly shown in FIG. 11, the second flange 32 is manufactured to form as tight a seal as possible with the rim 14. The angle of the second flange 32 when the sealing element 30 is not assembled is nearer to a horizontal plane than when the sealing element 30 is engaged with the inner portion 22, so that when assembled the second flange 32 is pulled down onto the rim 14 to produce a firm seal.

Figure 13:
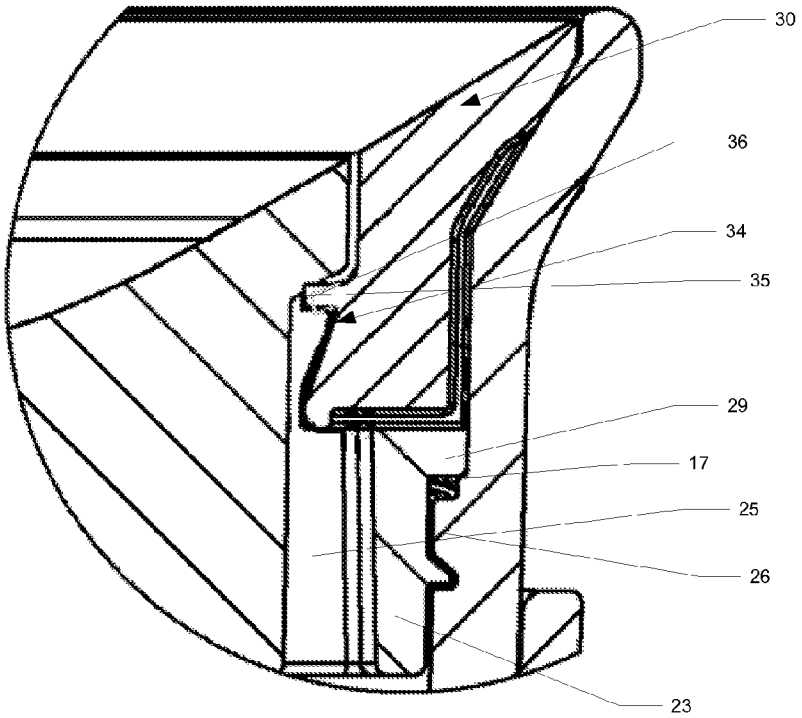
FIG. 13 is a schematic diagram of the pressure relief valve of FIG. 12 in greater detail.
Figure 14:
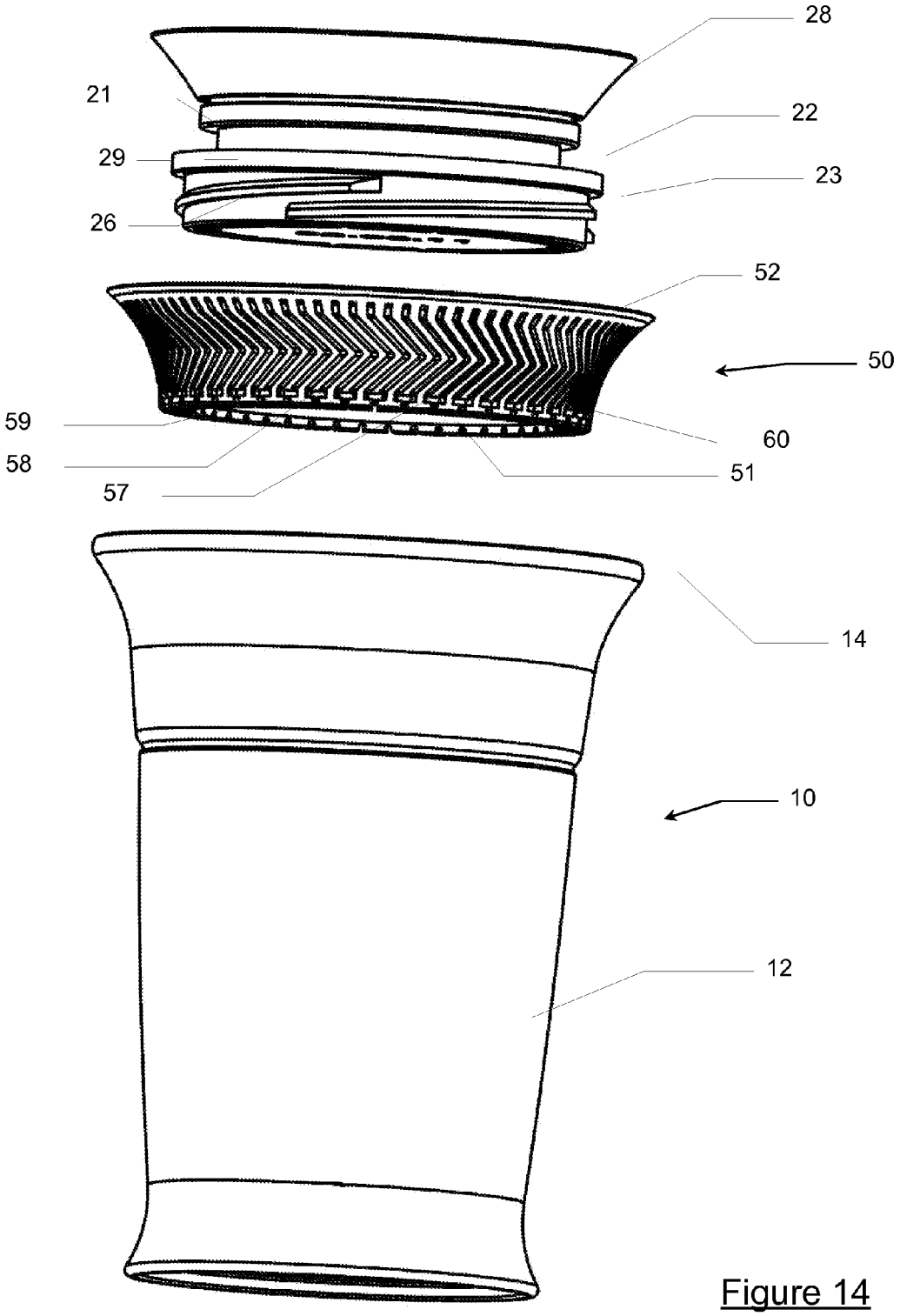
FIG. 14 is an exploded view of a drinking vessel constituting a second embodiment of the present invention.
Figure 15:
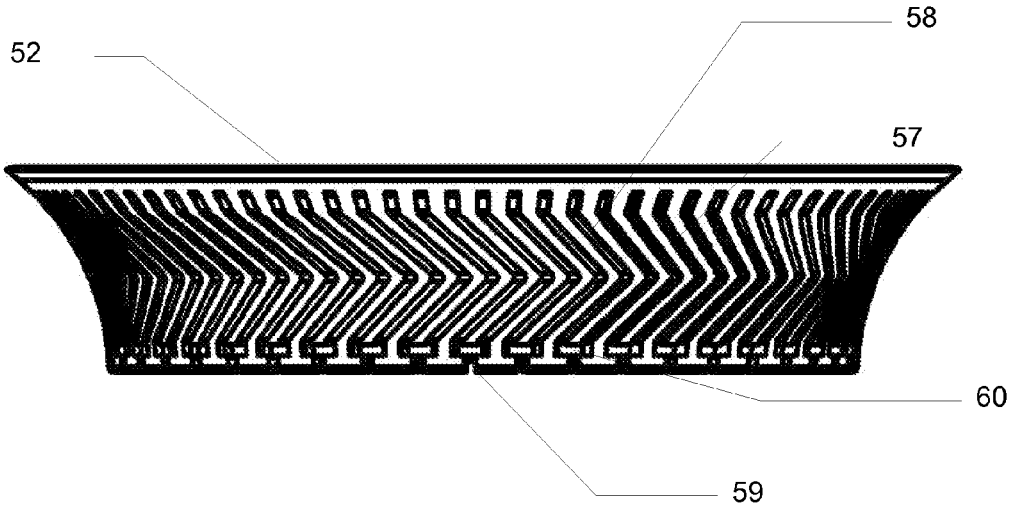
FIG. 15 is a side view of the elastomeric seal of the second embodiment.
Figure 16:
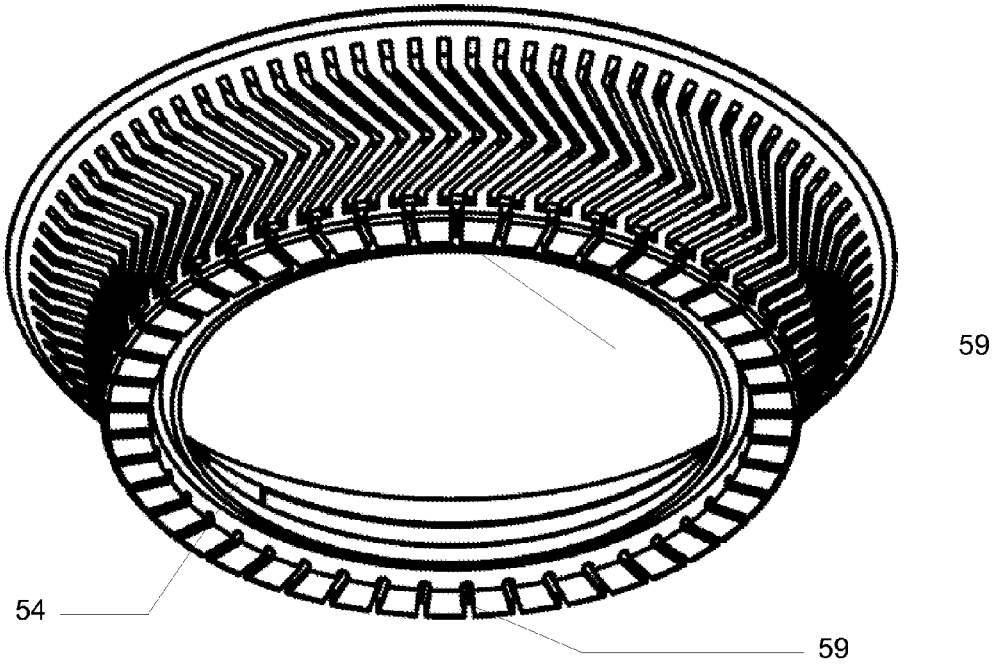
FIG. 16 is a perspective view of the elastomeric seal of the second embodiment from below said seal.

As is more clearly shown in FIG. 13, there are two distinct fluid flow systems, one for liquid and one for air, which enable optimum functional characteristics. A liquid flow system extends from the chamber 13 and incorporates the apertures 25 between the radial extensions 24, and the channels 38 provided between the parallel projections 37 and the inner sealing surface 15. As shown in FIG. 13, the liquid flow system is kinked between the channels 38 and the apertures 25. This kink is provided in order to mitigate leakage from the seal formed between the sealing element 30 and the sealing surface 15 in the event of a so-called "shock condition" when the drinking vessel is shaken, possibly violently. This kink contributes to a labyrinthine flow system for liquid to follow to exit the vessel. The liquid flow system then extends between the rim 14 and the flange 32. An air flow system extends through the air valves 34 and the apertures 25 between the radial extensions 24. The air and the liquid flow systems exist so that as liquid is drawn from the chamber 13, air can enter the chamber 13 to equalise the pressure created by the egress of liquid.

In use, the lid 20 is releasable from the container 10 by unscrewing the inner member 21 from the container 10. The chamber 13 in the container 10 can then be filled with liquid, and the lid 20 can then be reattached by screwing the inner member 21 back into the container 10. To drink from the drinking vessel, a user lifts the container to their lips, and attempts to draw liquid from the chamber 13 by sucking from the rim 14 and the sealing element 30. The sucking action creates a pressure differential between the inside of the chamber 13 and the mouth of the user, thereby causing liquid to be drawn from the chamber 13 and out past the rim 14 and into the mouth of the user. The liquid flows through the liquid flow system, i.e. from the chamber 13, and past the apertures 25 in between the outer portion 23 and the cylindrical inner portion 22 of the inner member 21. The liquid then then flows into the channels 38 between the parallel projections 37 on the outer surface of the sealing element 30 in the region where the mouth of the user engages the rim 14. The liquid then exits the vessel between the flange 32 of the sealing element 30 and the rim 14 of the container 10.

So that the air pressure inside the chamber is equalised, air is then drawn back inside the chamber 13 through the air valve 34, as a result of a negative pressure formed in the chamber 13 when the liquid exited the chamber 13, causing the outwardly extending flaps 36 to flex away from the first flange 28. Once the air is equalised, the flaps 36 return to the rest position abutting the first flange 28 on the inner portion 22 to prevent any leakage of liquid therethrough.

Referring to FIGS. 14 to 19, there is shown an alternative embodiment of sealing element 50 in use with a container 10 and inner member 21 as previously described.

The sealing element 50 is made from an elastomeric material and comprises an annular body section 51 having a second flange 52 extending from an upper edge thereof. An annular shoulder 53 is provided at the inner surface of the body section 51. Equivalently to the first embodiment of sealing member 30, when assembled, it is the shoulder 53 of the sealing element 50 that abuts the first flange 28 disposed around the upper edge of the cylindrical inner portion 22. Further, the body section 51 has a base which abuts the radial extensions 24 between the inner portion 22 and the coaxial outer portion 23 of the inner member 21. The body section 51 of the sealing element 50 creates a fluid-tight seal with the inner portion 22 of the inner member 21. The second flange 52 on the sealing element 50 abuts the rim 14 of the container 10 and creates a fluid-tight seal therewith, the second flange 52 and the rim 14 combining to form a surface from which a user draws liquid during use.

Figure 17:
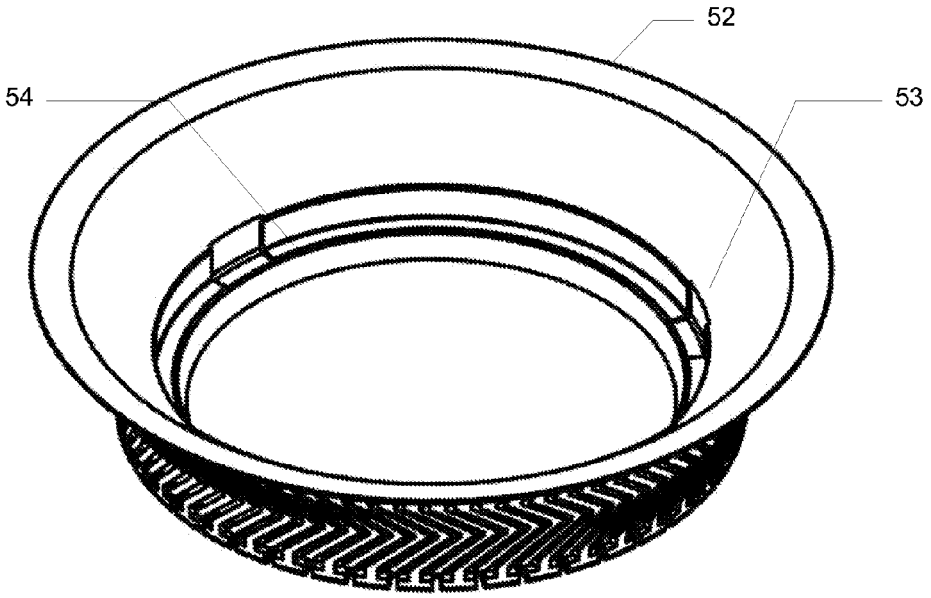
FIG. 17 is a perspective view of the elastomeric seal of the second embodiment from above said seal.
Figure 18:
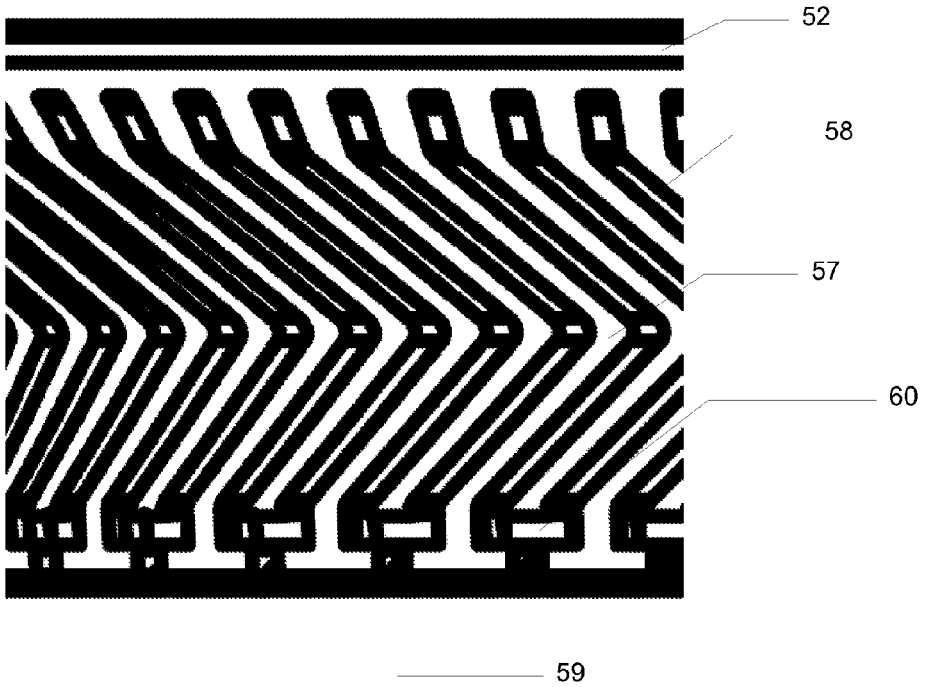
FIG. 18 is a close up of the channels of the elastomeric seal of the second embodiment.
Figure 19:
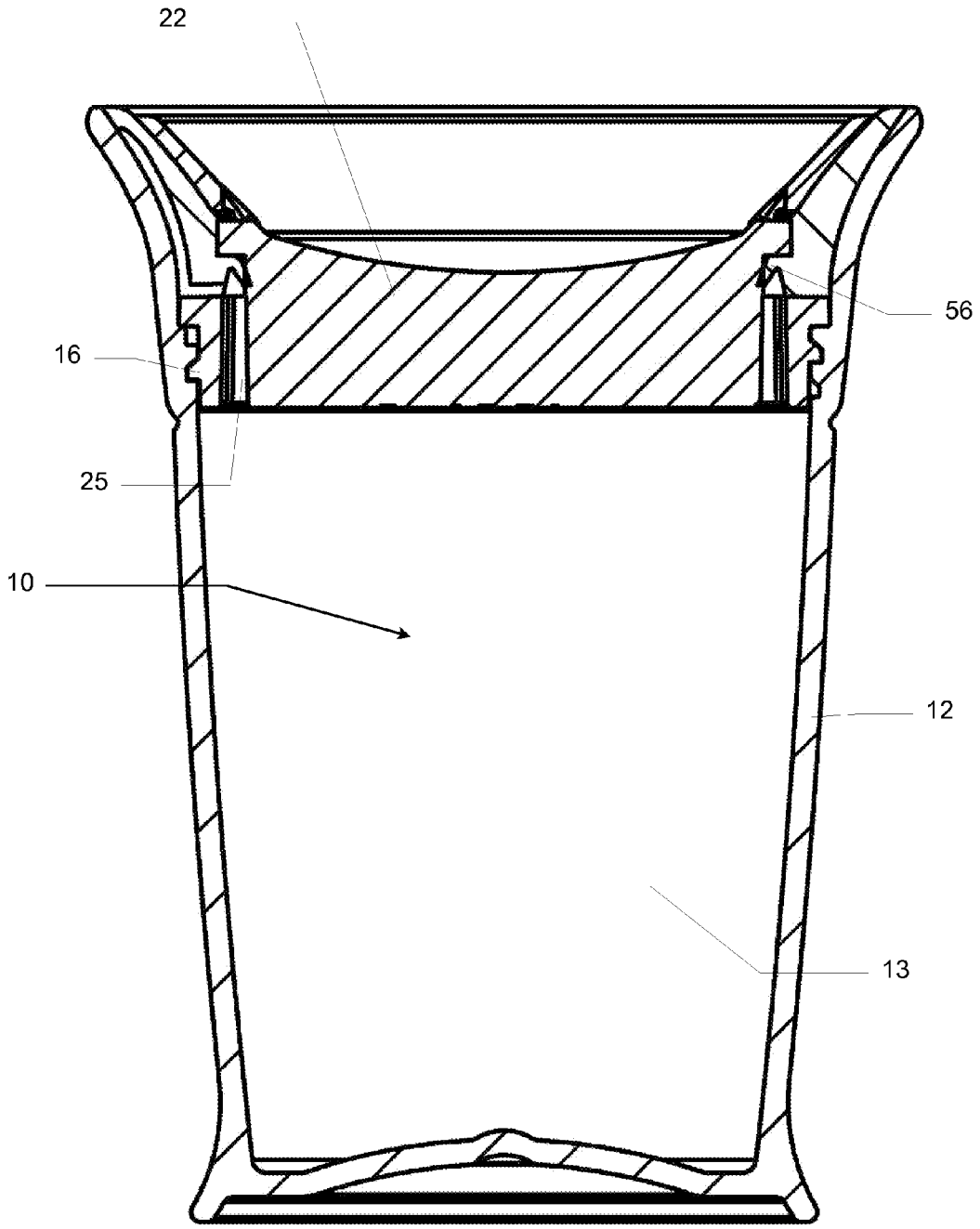
FIG. 19 is a cross-sectional view of a drinking vessel including the elastomeric seal of the second embodiment.

As most clearly shown in FIG. 17, positioned around an inner surface of the body section 201 are a series of air valves, generally indicated 54, which comprise notches 55 and outwardly extending flaps 56 (FIG. 19). As previously described, the air valves 54 act to equalise pressure in the drinking vessel that accrues after liquid has been withdrawn from the chamber 13 during use. The flaps 56 are deformable away from the flange 28 to allow air to enter the container 10 when the air pressure inside the chamber 13 is less than the air pressure on the outside of the chamber 13, and air then enters to equalise the pressure.

Referring to FIGS. 14 to 18, disposed around and extending the length of the outer surface of the body section 51 of the sealing element 50 are a series of parallel projections 57, defining therebetween a series of channels 58. The channels 58 are in fluid communication with the apertures 25 between the radial extensions 24 on the inner member 21 of the lid 20, and also between the lip 14 and the second flange 52. The channels 58 can be spaced apart between 0.4 mm and 6 mm and between 5 mm and 30 mm long, depending on the required application. The channels 58 in this embodiment of sealing element 50 are generally V- or chevron shaped in order to extend their length relative to the linear channels 38 as shown in the first embodiment of sealing element 30. The increased length of the channels 58 increases the resistance and damping of liquid in the channels 58, and as such further helps to mitigate leakage from the drinking vessel during shock conditions.

As shown most clearly in FIG. 17, the channels 58 include inlets 59 disposed at the lower edge of the sealing element 50. Each inlet 59 includes a bifurcation 60, making the inlet 59 generally T-shaped. As a result of the bifurcation 60, each inlet 59 supplies two channels 58, which extend one from each branch of the bifurcation 60. By having one inlet 59 per two channels 58 further increases the resistance and damping of the liquid, thus also mitigating the leakage of liquid from the drinking vessel during shock conditions. Although not shown here, one inlet 59 could be in fluid communication with three, four or even more channels 58 to further increase the liquid resistance, should this be required for particular uses of drinking vessel. For example, cups to be used by runners may benefit from increased liquid resistance because the cup will be subject to greater and more frequent shocks than a drinking vessel that will be used in the home or at work. Therefore, depending on use, a balance can be achieved between the ease of drawing liquid from the vessel against the need to increase shock performance.

Figure 20:
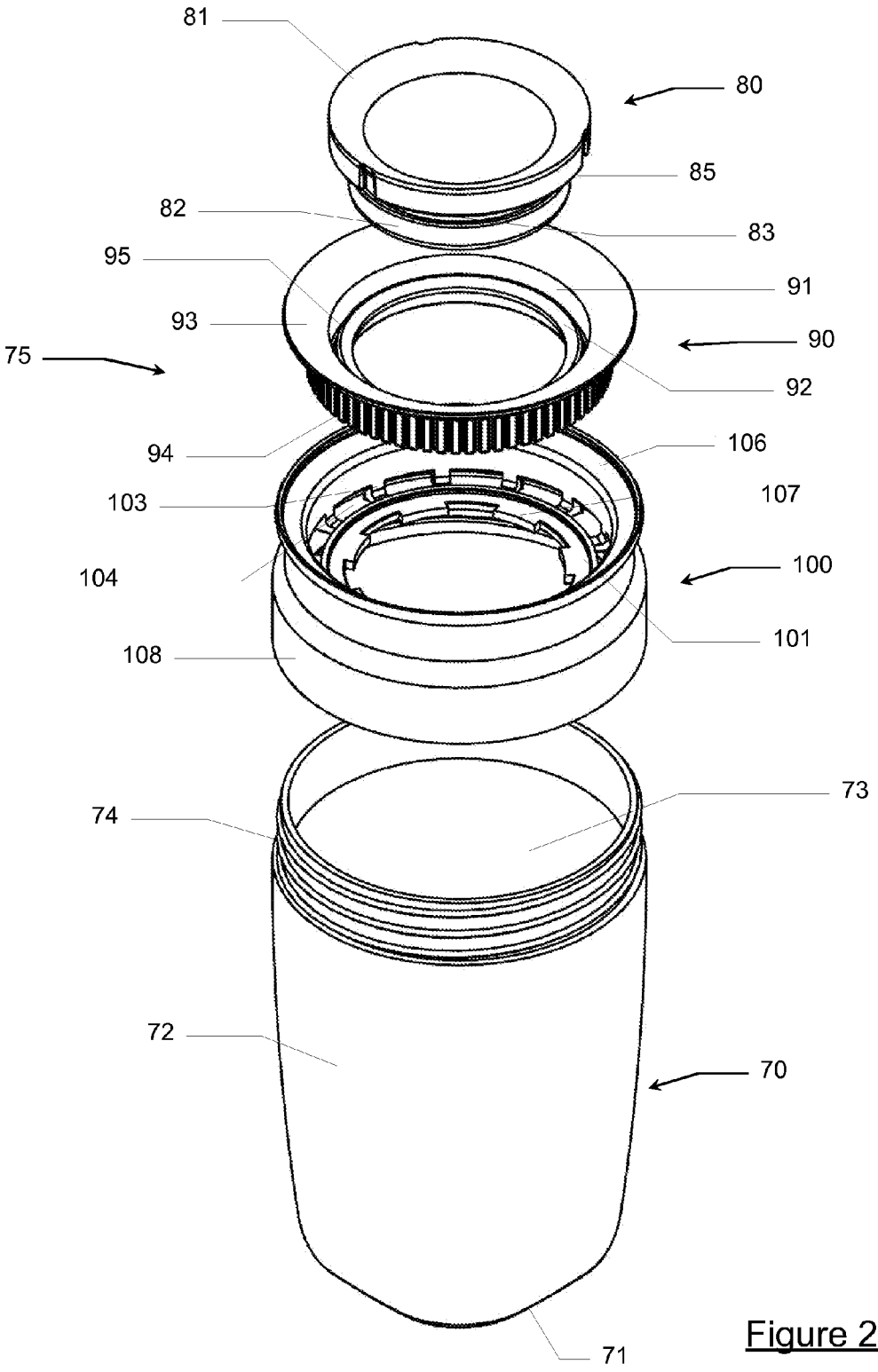
FIG. 20 is an exploded view of a drinking vessel constituting a third embodiment of the present invention.
Figure 21:
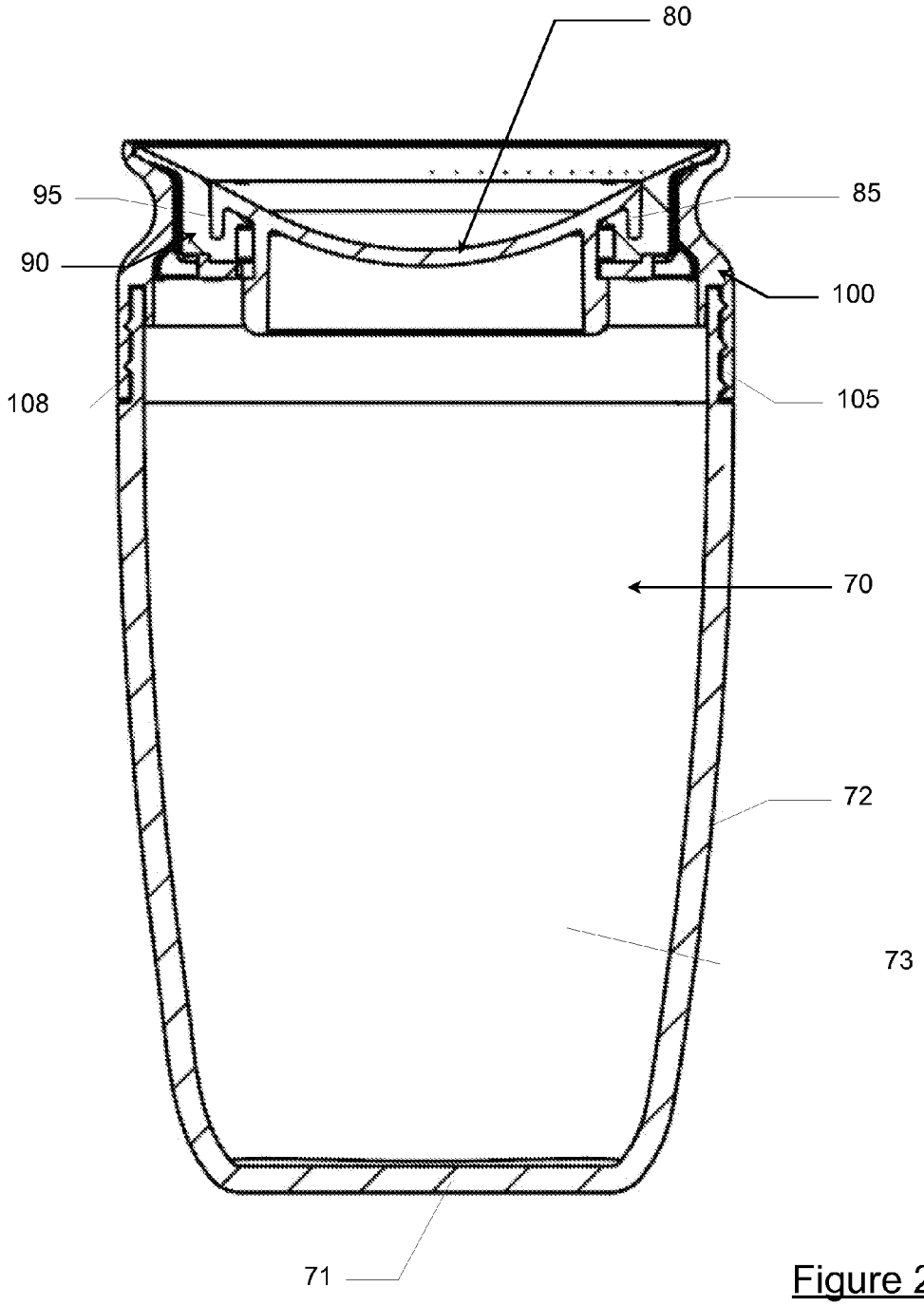
FIG. 21 is a cross-sectional view of the third embodiment of the present invention.

As more clearly shown in FIGS. 20 and 21, according to a second aspect of the present invention there is shown an alternative drinking vessel, comprising a container 70, and a lid, generally indicated 75. The container 70 comprises a base 71 and an upstanding circumferential side wall 72, defining therein a chamber 73 in which liquid is held during use. An upper edge of the side wall 72 defines an external screw thread 74 to which the lid 75 can be releasably attached in order to fill the vessel with liquid.

The lid 75 comprises an inner member, generally indicated 80, a sealing element, generally indicated 90, and an outer member, generally indicated 100.

The inner member 80 comprises an upper annular portion 81 and a lower annular portion 82, with a groove 83 therebetween. The upper annular portion 81 includes an overhang which cooperates with the sealing element 90 when combined. The outer member 100 comprises a cylindrical inner portion 101 and a coaxial outer portion 102. The outer portion 102 is connected to the inner portion 101 by a series of radial extensions 103, which define a series of apertures 104 therebetween through which liquid can pass. The outer portion 102 has a collar 108 including an internal screw thread 105 arranged to cooperate with the external screw thread 74 of the container 70, and also an outwardly extending rim 106 disposed above the screw thread 105. Within the cylindrical inner portion 101 is a series of flexible teeth 107 which permit a snap fit engagement with the inner member 80, as more clearly shown in FIG. 21.

The sealing element 90 is made from an elastomeric material and comprises an annular body section 91 having an inner flange 92 and an outer flange 93, with a groove therebetween in which overhang 85 fits when the lid 75 is assembled. When assembled, the inner flange 92 fits within the groove 83 of the inner member 80. The body section 91 of the sealing element 90 creates a fluid-tight seal with the inner member 80. The outer flange 93 on the sealing element 93 abuts the rim 106 of the outer member 100 and creates a fluid-tight seal therewith, the outer flange 93 and the rim 106 combining to form a surface from which a user draws liquids during use. The sealing element 90 has a series of channels 94, which cooperate with the apertures 104 in the outer member 100 in an equivalent manner as described in relation to the first and embodiment, so this will not be repeated. However, the alternative channel arrangements described above could also apply to the sealing element 90 of this embodiment.

The entire lid 75 can be removed from the container 70 to fill the container 70 before use by unscrewing the cooperating screw threads 74,105 between said lid 75 and said container 70.

The invention claimed is:

1. A drinking vessel comprising a generally cylindrical container for containing liquid and a lid, the drinking vessel comprising a generally cylindrical inner member and a generally cylindrical sealing element surrounding the inner member, wherein the drinking vessel further comprises a rim and an inner circumferential sealing surface, the inner member and the sealing element being fixedly insertable into the container in order, when the inner member and the sealing element are inserted, to cause the sealing element to lie against the sealing surface so as normally to form a seal with the sealing surface, the seal being deformable by suction at the rim such that under action of a suction liquid within the container is caused to flow from a chamber inside the container out past the rim, wherein:

the sealing element and the sealing surface cooperate to define a plurality of channels; and the channels extend from at or near a end of the seal adjacent the rim to a point at or near a base of the seal.

2. The drinking vessel according to claim 1, wherein the plurality of channels extend from the rim towards a base of the container.

3. The drinking vessel according to claim 1, wherein the channels are formed from grooves in the outer surface of the sealing element.

4. The drinking vessel according to claim 1, wherein the channels contain a kink therein.

5. The drinking vessel according to claim 4, wherein the kink is provided in both the sealing element and the inner sealing surface of the container.

6. The drinking vessel according to claim 1, wherein the channels are spaced between 0.4 mm and 6 mm apart.

7. The drinking vessel according to claim 1, wherein the channels have a cross section of between 0.8 $mm^2$ and 3.5 $mm^2$.

8. The drinking vessel according to claim 1, wherein the total length of the channels is between 5 mm and 30 mm.

9. The drinking vessel according to claim 1, wherein the channels deviate from a linear path.

10. The drinking vessel according to claim 9, wherein the path of the channels is V shaped, chevron shaped, or zigzagged.

11. The drinking vessel according to claim 1, wherein an inlet is disposed in the sealing element at an end towards the base of the container, the inlet being in fluid communication with two or more channels.

12. The drinking vessel according to claim 1, wherein the inner member is provided with a screw thread on an outer surface thereof adapted to cooperate with a screw thread on the inside surface of the container.

13. The drinking vessel according to claim 1, wherein the sealing element is a cylindrical seal formed as a single piece part.

14. The drinking vessel according to claim 1, wherein the sealing element is an annular seal adapted to be removably pulled over the inner member.

15. The drinking vessel according to claim 1, wherein the sealing element includes one or more air valve.

* * * * *